US006491080B2

(12) United States Patent
Tasma

(10) Patent No.: US 6,491,080 B2
(45) Date of Patent: Dec. 10, 2002

(54) LABEL PRINTER/APPLICATOR WITH IMPROVED LABEL CUTTING, CONTROL AND APPLICATION AND METHOD FOR DOING THE SAME

(75) Inventor: Gerald Wayne Tasma, Cedar Springs, MI (US)

(73) Assignee: Grand Rapids Label Company, Grand Rapids, MI (US)

( * ) Notice: Subject to any disclaimer, the term of this patent is extended or adjusted under 35 U.S.C. 154(b) by 0 days.

(21) Appl. No.: 09/681,215

(22) Filed: Feb. 26, 2001

(65) Prior Publication Data

US 2001/0027845 A1 Oct. 11, 2001

Related U.S. Application Data

(63) Continuation-in-part of application No. 09/543,481, filed on Apr. 6, 2000.

(60) Provisional application No. 60/128,823, filed on Apr. 12, 1999.

(51) Int. Cl.[7] ..... B65C 9/26; B65C 9/28

(52) U.S. Cl. ..... 156/387; 156/497; 156/517; 156/556; 156/566; 156/DIG. 38

(58) Field of Search ..... 156/353, 354, 156/384, 497, 516, 517, 521, 540, 543, 556, 566, DIG. 31, DIG. 32, DIG. 33, DIG. 38

(56) References Cited

U.S. PATENT DOCUMENTS

| | | | | |
|---|---|---|---|---|
| 3,274,043 A | | 9/1966 | Schneider | |
| 4,425,181 A | | 1/1984 | Bahr et al. | |
| 4,526,648 A | | 7/1985 | Tochtermann | |
| 4,707,211 A | | 11/1987 | Shibata | |
| 4,784,714 A | | 11/1988 | Shibata | |
| 5,024,718 A | * | 6/1991 | Hannen | 156/475 |
| 5,221,350 A | * | 6/1993 | Tallier et al. | 118/694 |
| 5,344,519 A | | 9/1994 | Galchefski et al. | |
| 5,503,702 A | * | 4/1996 | Filicicchia et al. | 156/249 |
| 5,505,037 A | * | 4/1996 | Terminella et al. | 53/133.4 |
| 5,531,853 A | * | 7/1996 | Cubow et al. | 156/521 |
| 5,804,023 A | | 9/1998 | Carpenter et al. | |
| 5,813,772 A | * | 9/1998 | Magill et al. | 400/120.01 |
| 5,816,717 A | * | 10/1998 | Beadman et al. | 101/288 |
| 5,833,803 A | | 11/1998 | Strohmeyer et al. | |
| 5,885,406 A | | 3/1999 | Tiefel | |
| 6,182,730 B1 | * | 2/2001 | Muir | 156/387 |

* cited by examiner

*Primary Examiner*—Richard Crispino
*Assistant Examiner*—Cheryl N. Hawkins
(74) *Attorney, Agent, or Firm*—McGarry Bair LLP

(57) ABSTRACT

A label printer/applicator with improved label cutting, control and application has a control valve for alternately fluidly interconnecting an applicator head with a supply of pressurized air, a suction source and a neutral position. An atomizer nozzle is positioned beneath an applicator head for activating moisture-activated adhesives often provided on labels. An air jet nozzle beneath the applicator head prevents cantilever bending of a label exiting a printer and travelling toward the applicator head. A label can be controllably positioned beneath the applicator head by applying suction to the applicator head to retain the label to the applicator head, positioning an object to be labeled beneath the applicator head, releasing the suction to the applicator head and applying pressurized air to the applicator head to blow the label off of the applicator head and toward the object, and releasing the pressurized air from the applicator head without reapplying suction to the applicator head until another label is positioned beneath the applicator head.

23 Claims, 9 Drawing Sheets

LABEL PRINTER/APPLICATOR WITH IMPROVED LABEL CUTTING, CONTROL AND APPLICATION AND METHOD FOR DOING THE SAME

CROSS REFERENCE TO RELATED APPLICATIONS

This application is a continuation-in-part application of U.S. patent application Ser. No. 09/543,481, filed Apr. 6, 2000, which claims the benefit of U.S. Provisional Patent Application Ser. No. 60/128,823 filed Apr. 12, 1999.

BACKGROUND OF INVENTION

This invention relates to a label printer/applicator. In one of its aspects, the invention relates to a label printer and applicator with a mechanism for severing a label from a continuous web and transferring the label to an article such as a box. In another one of its aspects, the invention relates to a label printer and applicator with a label wetting device for wetting a label before it is applied to an article. In yet another of its aspects, the invention relates to a method of applying a label to an object.

In labeling objects such as packages, envelopes and the like, a label pasting and cutting apparatus is typically provided with a supply of label material on a continuous backing web or the like. Alternatively, the label material can be "linerless", i.e., without backing material. Typically, the label material on the backing is advanced from a supply reel, and through a printer, which can provide desired indicia such as text and graphics onto the label, in addition to any indicia already pre-printed onto the label. If the label material has a backing material, the backing material is advanced over a label separator roller or "peeler" bar onto a take-up reel while the label material, separated from the backing material, is advanced to a cutter and label applicator. By means of the cutter, the printed portion is cut from the continuous web of label material and is transferred to an object, such as package or envelope or the like, by the applicator.

Several problems have arisen in prior art label printing, cutting and applying devices. The label is often not cut cleanly from the continuous web of label material leaving an undesirable and aesthetically unpleasing appearance to the severed length of label material. Sometimes, moisture-activated or previously-applied adhesive label materials are employed which often leave residual adhesive (before or after any activating moisture is applied thereto). Further, in the case of moisture-activated adhesives, it is often difficult to activate the adhesive properly, often leaving a label which peels soon after application if not enough moisture was applied—or a wrinkled unattractive label which was over-saturated with moisture.

SUMMARY OF INVENTION

According to one aspect of the invention, a label application apparatus comprises a main housing having a roller thereon; a supply reel mounted to the main housing and having an indefinite length web of label material thereon; a printer mounted to the main housing adjacent to the roller; an applicator mounted to the main housing adjacent to the printer for applying a label to an object; a feed mechanism for feeding the continuous web of label material from the supply reel to the printer and applicator; and a cutting mechanism associated with the applicator to cut the labels between the printer and the applicator. The cutting mechanism can comprise a pivotally-mounted blade and a stationary blade.

In other aspects of the invention, a cutting mechanism for a label application apparatus to cut labels passing between a printer and an applicator in the label application apparatus, the cutting mechanism comprises a base; a stationary blade mounted to the base; and a pivotally-mounted blade pivotally mounted to one end of the stationary blade and at an opposite end to an air cylinder and the air cylinder is connected to a source of pressurized air.

In one embodiment of an improved label application apparatus, the pivotally-mounted blade is connected to an air cylinder and the air cylinder is connected to the source of pressurized air.

In various embodiments of the improved label application apparatus and cutting mechanism therefor, a cylinder valve can be fluidly interconnected between the air cylinder and the source of pressurized air for selectively controlling a supply of pressurized air to the air cylinder. A controller can be programmed to that selectively actuate the cylinder valve to deliver a burst of pressurized air to the air cylinder to pivot the pivotally-mounted blade to a cutting position adjacent to the stationary blade. A controller can be programmed to selectively actuate the atomizer valve to project a mist of adhesive-activating liquid beneath the applicator head before or substantially simultaneously with the application of a label onto an object by the applicator. An air jet nozzle can be disposed adjacent to the printer and directed at the applicator head, the air jet nozzle being fluidly interconnected to the pressurized air source, a nozzle valve fluidly interconnected between the air jet nozzle and the pressurized air source for selectively controlling a supply of pressurized air to the air jet nozzle.

In other embodiments, the stationary cutting blade can include a base and the base has at least one air jet fluidly interconnected to a source of pressurized air. The air jet can be in register with a feed path of the web and aligned to direct a burst of pressurized air toward the web. The at least one air jet can comprise a pair of air jets directed generally transversely on opposing sides of the base. One end of the stationary blade can be pivotally mounted to one end the pivotally-mounted blade. An opposite end of the pivotally-mounted blade can be mounted to an actuator, wherein the actuator can be selectively movable between a raised position whereby the pivotally-mounted blade is located in a non-cutting position and a lowered position whereby the pivotally-mounted blade is moved to a cutting position. The actuator can comprise a selectively-actuated pneumatic cylinder.

At least one of the pivotally-mounted blade and the stationary blade can comprises a curved cutting surface. The curved cutting surface can have a predetermined tangential angle which thereby configures the curved cutting surface to apply a generally constant cutting pressure to the web. At least one of the pivotally-mounted blade and the stationary blade can comprises a longitudinally-extending adhesive accumulation recess in register with the other of the pivotally-mounted blade and the stationary blade whereby excess adhesive encountered during cutting operations is accumulated in the adhesive accumulation recess and not on cutting surfaces of the at least one of the pivotally-mounted blade and the stationary blade.

BRIEF DESCRIPTION OF DRAWINGS

The invention will now be described with reference to the drawings in which.

DETAILED DESCRIPTION

Figure 1:
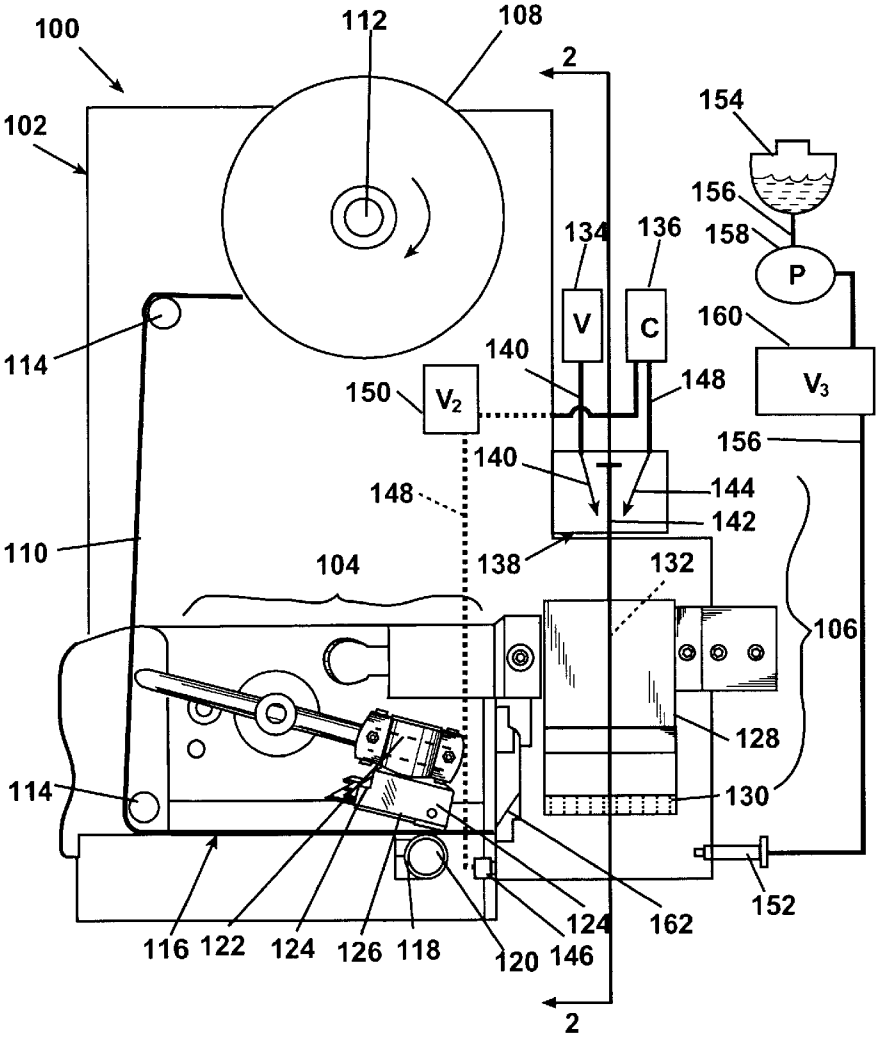
FIG. 1 is a schematic front elevational view of a label printer/applicator according to the invention.

Referring now to the drawings and to FIG. 1 in particular, a label printer/applicator 100 is shown comprising a housing 102 which mounts a printer 104 and an applicator 106.

The housing 102 rotatably mounts a supply reel 108. The supply reel 108 carries a wound length of a continuous web 110 which is often applied to a backing material (not shown). In the description provided herein the printer/applicator 100 is shown operating with a "linerless" label web 110, although it can be plainly seen that an alternative label material 110 having a backing layer can be used without departing from the scope of this invention.

The supply reel 108 is rotatably mounted on a support axle 112 which, in turn, is mounted to the housing 102. One or more slack rollers 114 can be rotatably mounted to the housing 102 for guiding a tensioned length of the continuous label web 110 toward the printer 104.

The housing 102 has a printer platform 116 adapted to receive the label web 110 from the supply reel 108 located adjacent a lower portion of the housing 102 which has a recess 118. A print roller 120 is rotatably mounted to the housing 102 within the recess 118. The print roller 120 is preferably imparted with rotational motion by a conventional motor (not shown) which is mounted to the housing 102. The print roller 120 preferably has an outer diameter sized with the recess 118 so that an outer surface of the print roller 120 is generally flush with an outer surface of the printer platform 116. It has also been found that the print roller 120 can extend beyond the recess 118 a small amount to allow for abutment of the label web 110 passing over the recess 118.

The printer 104 comprises a printer housing 122 which has a lower portion 124 provided with a conventional print head 126. The print head 126 can be any conventional print head from the many known in the art such as a dot matrix, thermal transfer, ink jet, etc. The print head 126 is interconnected to an information store (not shown) which provides proper instructions to the print head 126. The printer housing 122 is mounted to the housing 102 in register with the print roller 120.

The applicator 106 is mounted to the housing 102 downstream of the printer 104 and generally comprises a head 128 which is adapted to receive a length of printed label web 110 from the printer 104, retain the length of printed label web 110 while a label 110' is severed from the remaining continuous length of label web 110 and apply the label 110' to an object adjacent to the printer/applicator 110.

The printer/applicator 100 operates generally by providing the supply reel 108 with a length of label web 110. The label web 110 is fed over the slack rollers 114, onto the printer platform 116 and between the print roller 120 and the print head 126 where the label web 110 is printed with any desired indicia such as text and graphics. Rotation of the print roller 120 drives the label web 110 between the print head 126 and the print roller 120.

After the label web 110 is printed, the label web 110 is fed to the applicator 106 where a discrete label 110' is severed from the label web 110 and applied to an object. If a label web 110 having backing material is used, the backing material (not shown in FIG. 1) is peeled from the label web 110 and collected on a secondary accumulator such as a take-up reel as is well known in the art.

The support axle 112 for rotatably mounting supply reel 108 is typically nonrotatably mounted to the housing 102. The supply reel 108 includes an aperture therethrough for sliding reception onto the supply reel axle 112. Once properly mounted thereon, the supply reel 108 is free to rotate about the support axle 112 as the continuous label web 110 is pulled therefrom to feed the printer 104 and the applicator 106. The support axle 112 preferably receives a set screw, clamp or other retainer for maintaining the supply reel 108 on the support axle 112.

FIG. 1 shows several of the inventive features of the applicator 106. The head 128 of the applicator 106 has a distribution grid 130 which generally comprises a varied pattern of small apertures adapted to distribute fluid flow to and from a single supply conduit 132. The supply conduit 132 of the vacuum head 128 is interconnected to a vacuum source 134 and a pressurized air source 136, such as an air compressor, via a shuttle valve 138.

The shuttle valve 138 preferably has first, second and third selectable conduits 140, 142 and 144, respectively, which allow the vacuum source 134, a neutral position and the pressurized air source 136, respectively, to be interconnected with the supply conduit 132 of the vacuum head 128. Selective actuation of the shuttle valve 138 permits vacuum, no fluid flow, and pressurized air, respectively, to be delivered through the supply conduit 132 to the vacuum grid 130 at the base of the head 128 at selected points of the process for operating the applicator 106 described below.

Another important feature of the applicator 106 is the provision of an air jet nozzle 146 adjacent to the print roller 120 and preferably aligned with the direction of advancement of the web 110. The air jet nozzle 146 is also preferably interconnected with the pressurized air source 136 by a conduit 148. A second valve 150 can be provided in the conduit 148 for selectively controlling the supply of pressurized air to the air jet nozzle 146. Upon actuation of the second valve 150, a burst of pressurized air is supplied to the air jet nozzle 146 for important purposes described below.

Yet an additional important feature of the applicator is an atomizer 152 located on the housing 102 and directed toward the distribution grid 130. The atomizer 152 is shown schematically in FIG. 1 as a nozzle and provides a burst of vaporized liquid, preferably water, for activating the adhesive on moisture-activated label 110'. The atomizer 152 is interconnected to a source of fluid, such as water tank 154 or other adhesive activator, by a conduit 156. A pump 158 and a third valve 160 can be provided in the conduit 156 for delivering and controlling the supply of the fluid to the atomizer 152. Upon actuation of the third valve 160 and the pump 158 as needed, a burst of fluid can be supplied to the atomizer 152 which, in turn, creates a mist of adhesive activator, in many cases water, beneath the distribution grid 130 which will be further described below.

Figure 2:
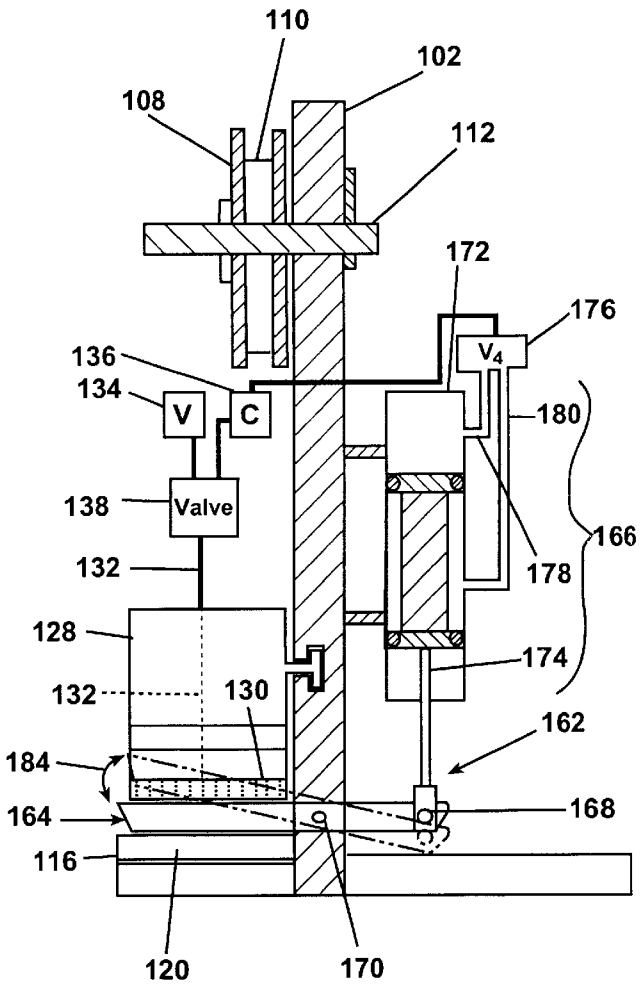
FIG. 2 is a schematic sectional view of the label printer and applicator of FIG. 1 taken along lines 2—2 of FIG. 1 and showing a cylinder having an axially-extendable piston mounted to an inner end of the knife.

A cutter 162 for severing a label 110' from the web 110 supplied by the supply reel 108 is shown in FIG. 1 and in greater detail in FIG. 2 located between the printer 104 and the applicator 106. Turning now to FIG. 2, the cutter 162 comprises a blade 164 which is pivotally mounted at 168 to an actuator 166 at a distal end thereof and pivotally mounted to the housing 102 at 170. The actuator 166 can be any device which can impart the requisite degree of motion to the blade 164 of the cutter 162.

In FIG. 2, the actuator 166 is shown as a cylinder 172 which has an axially extendible piston 174 mounted therein. The cylinder 172 is preferably interconnected to a fourth valve 176 by first and second conduits 178 and 180 located on either side of an inner end of the piston 174. The fourth valve 176, in turn, is fluidly interconnected to the pressurized air source 136 by a conduit 182. Actuation of the fourth valve 176 selectively interconnects the first and second conduits 178 and 180 with the pressurized air source 136 thereby extending and retracting the piston 174 with respect to the cylinder 172.

Figure 4:
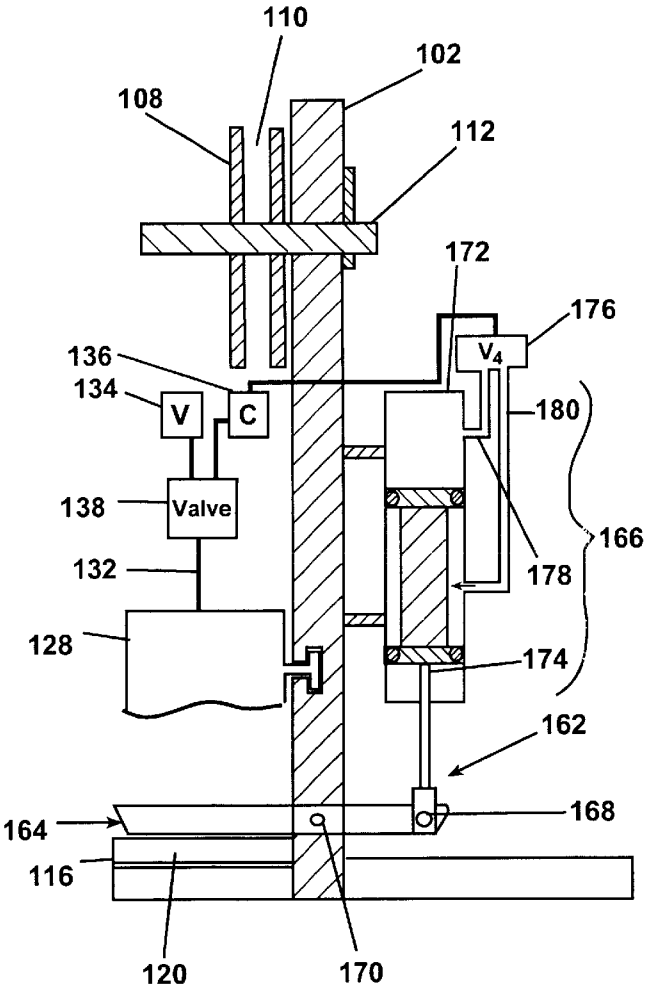
FIG. 4 is a partial sectional view similar to FIG. 3 showing the piston and knife in a lowered cutting position upon a proper signal to the control valve to retract the piston within the cylinder.
Figure 3:
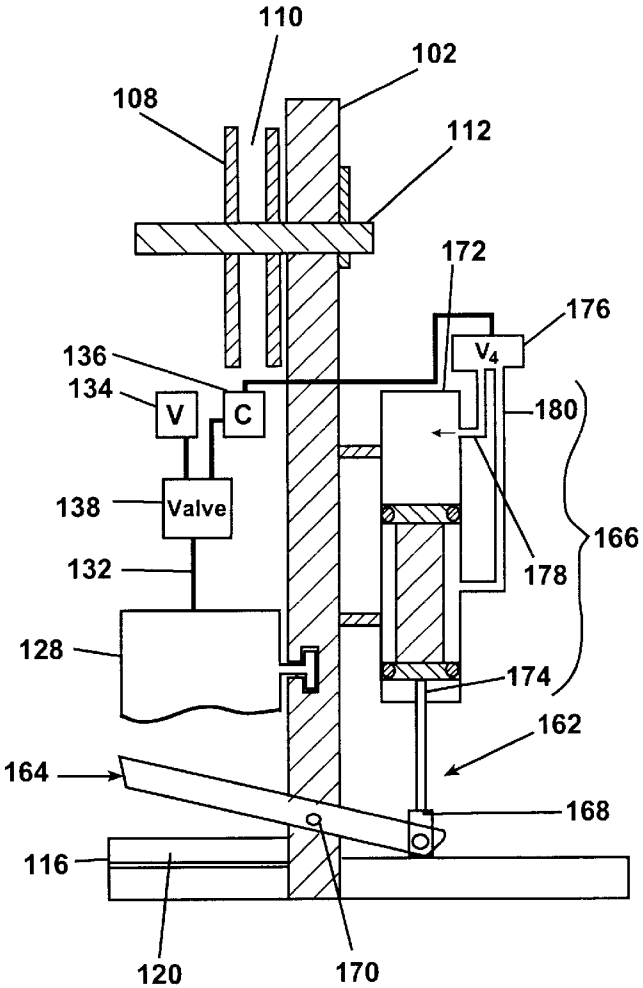
FIG. 3 is a partial sectional view like FIG. 2 showing the cylinder interconnected to a control valve which controls the ingress and egress of pressurized air into the cylinder, the piston being positioned in an extended position relative to the cylinder whereby the knife is shown positioned in the raised non-cutting position and the remaining elements of the applicator have been removed or shown partially for purposes of clarity.

FIGS. 3 and 4 illustrate the movement of the blade 164 when the piston 174 of the actuator 166 is moved. Extension of the piston 174 with respect to the cylinder 172 urges the first pivotal mounting 168 of the blade 164 downwardly which, in turn, pivots the blade 164 relative to the second pivotal mounting 170 of the blade 164 and thereby positions the blade 164 in a raised non-use position out of obstruction of the advancement path of the label 110' exiting the printer 104.

Retraction of the piston 174 with respect to the cylinder 172 causes the piston 174 to urge the first pivotal mounting 168 of the blade 164 upwardly which, in turn, pivots the blade 164 relative to the second pivotal mounting 170 of the blade 164 and thereby positions the blade 164 in a lowered cutting position which severs a label 110' exiting the printer 104. Further, the lowered cutting position of the blade 164 serves to obstruct the path of any splattering adhesive inadvertently directed toward the printer 104 or the air jet nozzle 146 thus preventing the printer 104 and the air jet nozzle 146 from being damaged, dirtied or clogged.

The blade 164 preferably traverses an arcuate cutting path 184 as shown in FIG. 2. The cutting surface on the blade 164 "slices" through the label web 110 advanced past the printer 104 in the arcuate cutting path 184. This slicing motion of the blade 164 as dictated by the first and second pivotal mountings 168 and 170 of the blade 164 to the actuator 166 and to the housing 102, respectively, are configured to impart this motion to the blade 164.

Figure 5:
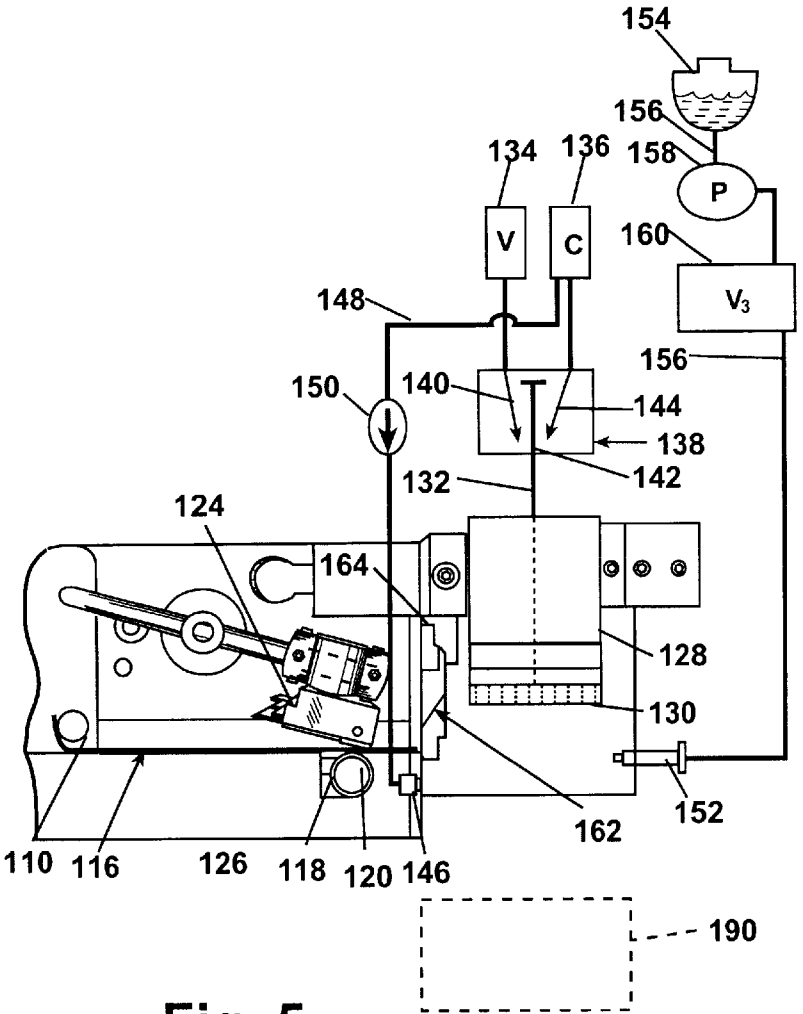
FIG. 5 is a partial schematic front elevational view of the label printer/applicator of FIGS. 1–4 showing the print head, print roller and the applicator in an initial position whereby label web is advanced between the print head and the print roller for printing indicia on the label web.
Figure 8:
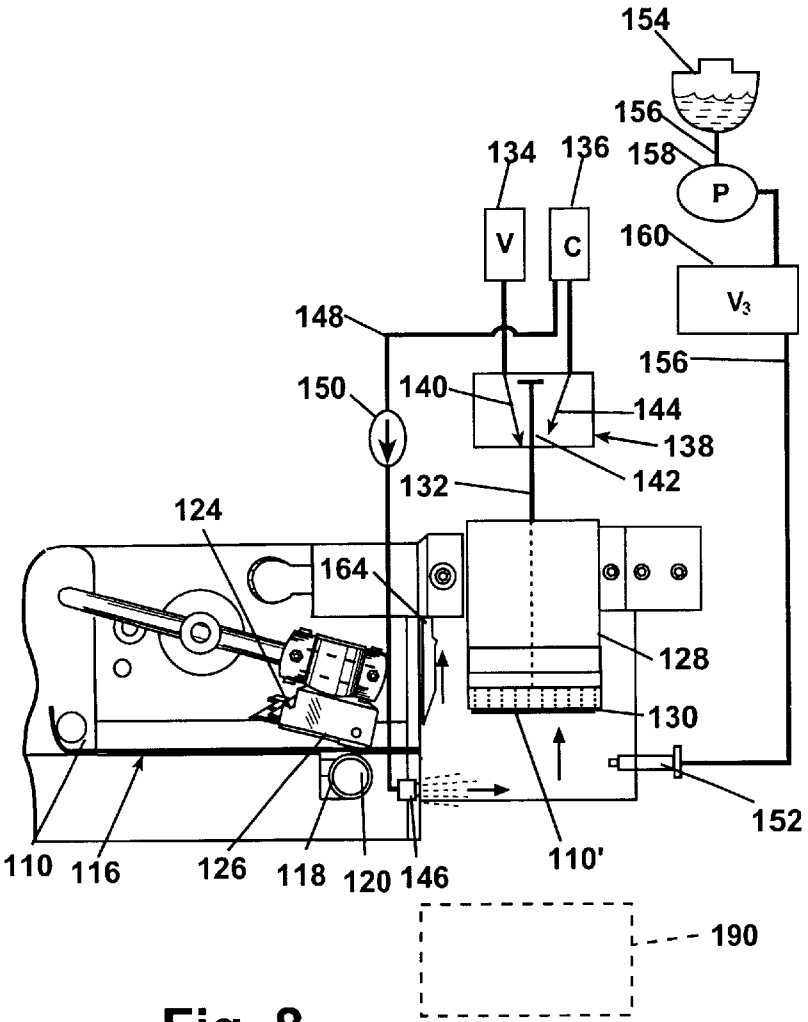
FIG. 8 is a partial schematic and front elevational view of the label printer/applicator shown in FIGS. 1–5 in similar orientation to FIG. 7 wherein the knife is raised to the position shown in FIG. 3, wherein the air jet has been activated to blow the label against the head of the applicator and the shuttle valve has been actuated to interconnect the head of the applicator with the source of vacuum whereby the label is retained against a lower surface of the head.

The method of operation of the printer/applicator 100 will now be described with reference to FIGS. 1–4 in general and to FIGS. 5–10 in particular. It will be understood that the label web 110 has been fed from the supply reel 114, delivered to the print head 126 on the printer 102 and is ready for application on an object 190 to be labeled. Turning to FIG. 5, the print head 126, print roller 120 and the applicator 106 are positioned with the label web 110 therebetween. In FIG. 5, the first valve 138 has been positioned to interconnect the supply conduit 132 to the neutral conduit 142 so that no fluid flow is provided to the distribution grid 130 at the base of the head 128. In addition, the second valve 150 has been positioned so that no fluid flow is provided to the air jet nozzle 146 and the third valve has been positioned so that no fluid flow is provided to the atomizer 152. The blade 164 is preferably positioned in the raised non-use position by the actuator 166 as discussed with respect to FIG. 3.

Figure 6:
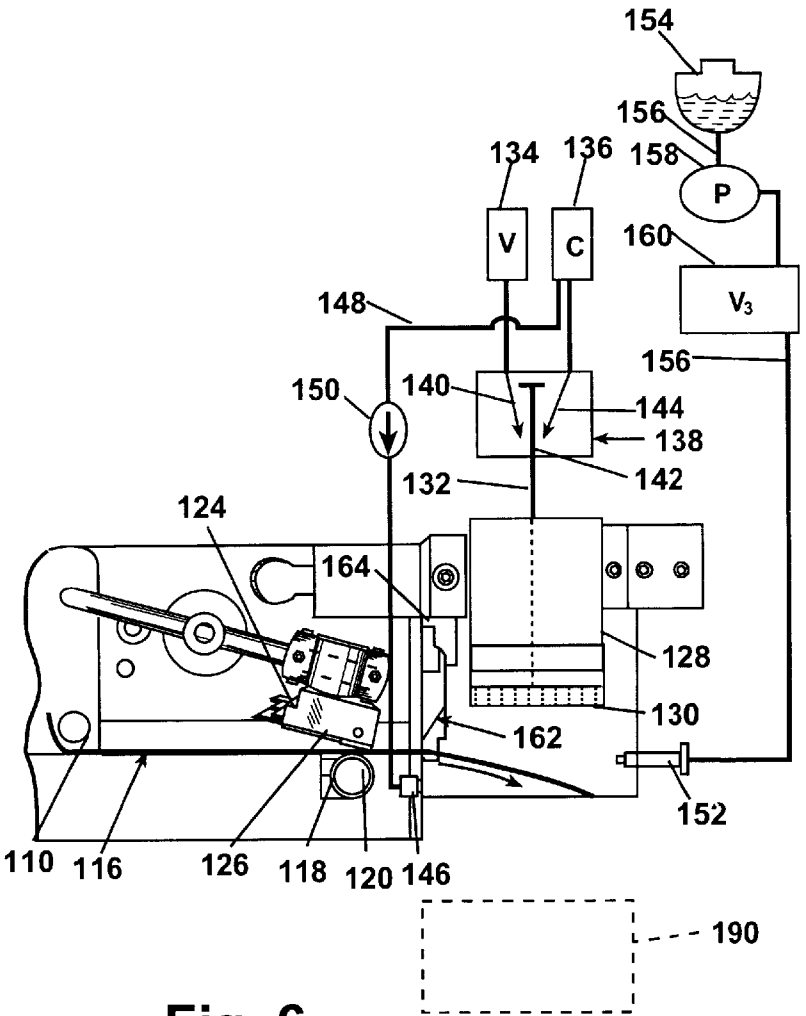
FIG. 6 is a partial schematic and front elevational view of the label printer/applicator shown in FIGS. 1–5 in similar orientation to FIG. 5, showing the label web advanced in cantilever fashion beyond the print head and beneath the vacuum head of the applicator whereby the label web is shown bending under its own weight beneath the vacuum head.

Once the label web 110 has been printed by the printer 104, it is advanced beyond the printer 104 beneath the distribution grid 130 on the head 128 of the applicator 106 as shown in FIG. 6. The continuous label web 110 is preferably advanced in cantilever fashion beyond the printer 104 whereby the label web 110 bends under its own weight beneath the head 128.

At this point, many steps occur in a quick successive (and even simultaneous) fashion and these steps are illustrated in FIGS. 7–10. Each of these steps is described individually with respect to each of the steps as shown in FIGS. 7–10, however, it will be understood that the time interval between each of these steps is miniscule.

Figure 7:
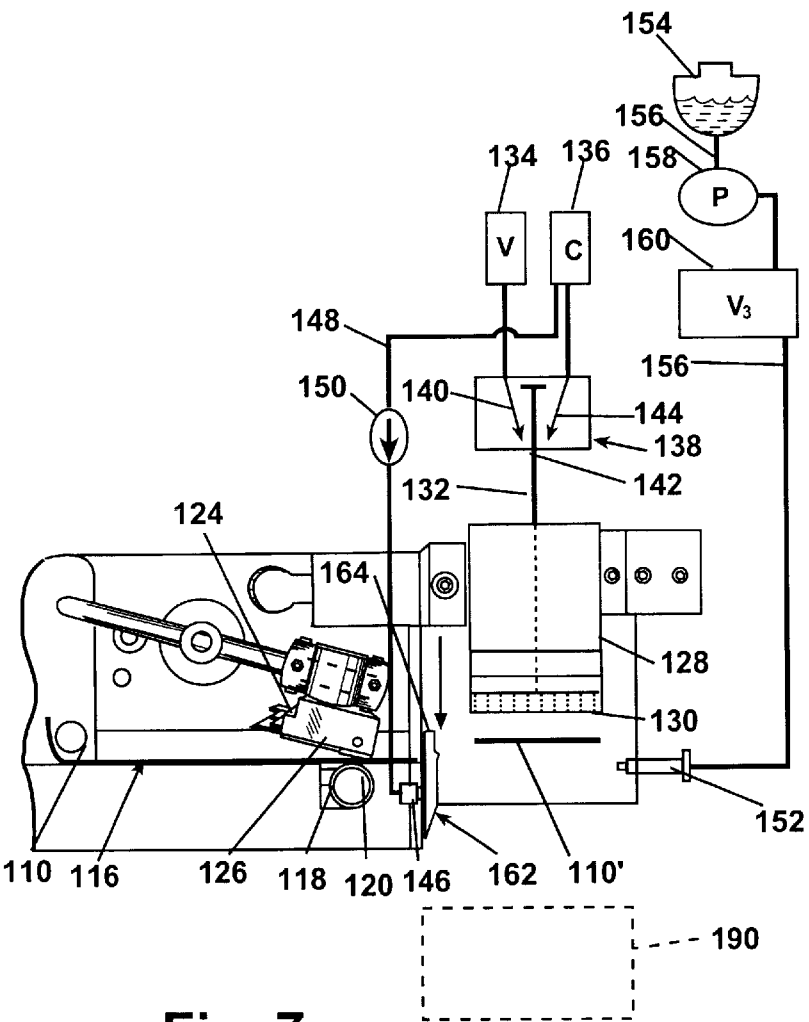
FIG. 7 is a partial schematic and front elevational view of the label printer/applicator shown in FIGS. 1–5 in similar orientation to FIG. 6 wherein the knife is moved to the lowered cutting position shown in FIG. 4 whereby a severed label is located beneath the head of the applicator.

To sever a label 110' from the continuous web exiting the printer 104, the fourth valve 176 (FIGS. 2–4) is actuated to switch the supply of pressurized air from the first conduit 178 (FIGS. 2–4) to the second conduit 180 (FIGS. 2–4), thereby retracting the piston 174 within the cylinder 172. The blade 164 is thereby lowered into the cutting position as shown in FIG. 7 and, in turn, severs the label 110' from the web.

When the label 110' is severed from the web 110, the label often bends due to its own weight and the cantilever fashion in which it was extended beyond the printer platform 116 and the printer 104. To counteract this misalignment of the label 110' with respect to the distribution grid 130 of the head 128 of the applicator 106, the second valve 150 is actuated which supplies pressurized air to the air jet nozzle 146 located beneath the head 128 of the applicator 106. The air jet nozzle 146 thereby blows the label 110' toward the distribution grid 130 of the head 128. Relatively contemporaneously with the activation of the air jet nozzle 146, the first valve 138 is positioned to fluidly interconnect the first conduit 140 with the supply conduit 132, thereby fluidly interconnecting the vacuum source 134 with the distribution grid 128. Vacuum is thereby applied to the label 110' to retain the label 110' against the distribution grid 130 as aided by the burst of air from the air jet nozzle 146.

Figure 9:
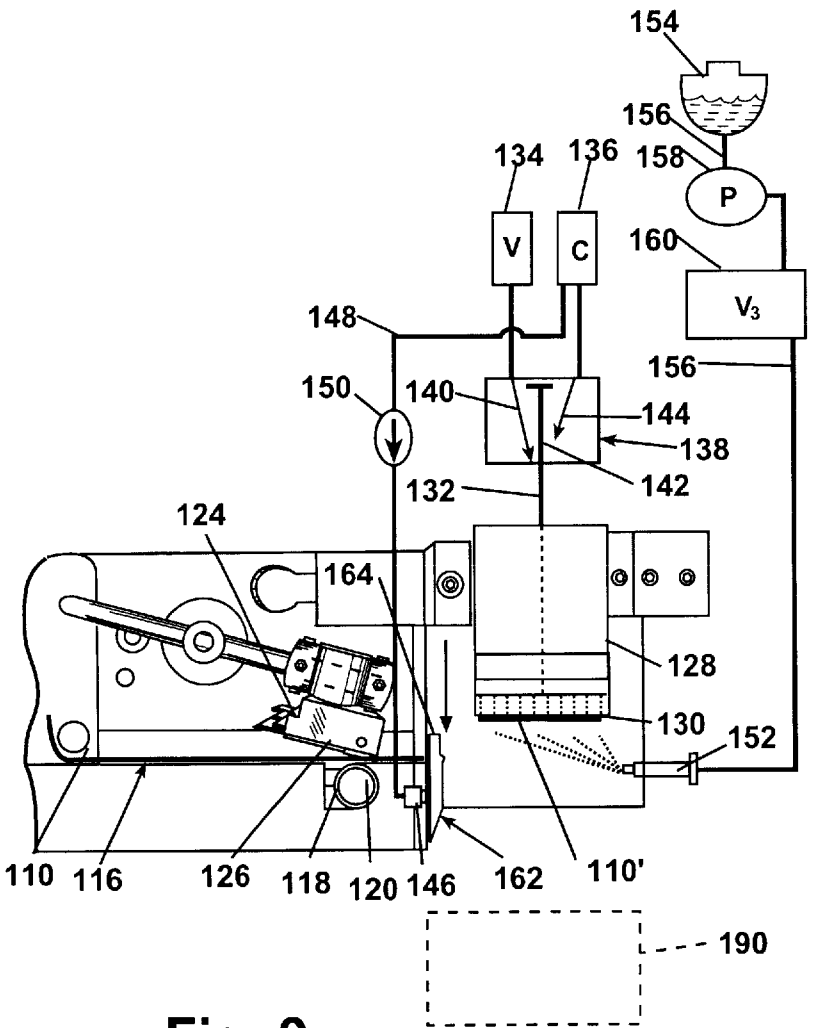
FIG. 9 is a partial schematic and front elevational view of the label printer/applicator shown in FIGS. 1–5 in similar orientation as FIG. 8 wherein the knife is lowered to the cutting position shown in FIG. 4 to protect the printer and the air jet nozzle as the atomizer is activated to provide a mist of liquid droplets to wet the underside of the label to the extent moisture-activated label material is used.

If a moisture- or liquid-activated adhesive for the label 110' is employed, FIG. 9 shows the method step where the third valve 160 (and the pump 158 where needed) is actuated to supply a burst of pressurized liquid to the atomizer 152. The atomizer 152 thereby distributes a misting of fluid over the exposed underside of the label 110' retained against the distribution grid 130. It will be noted that the blade 164 has now reached a fully lowered position so that the blade 164 covers the return path to the printer 104 and entry into the air jet nozzle 146. The air jet nozzle 146 can thereby be deactivated through deactivation of the supply of pressurized air from the source 136 through the second valve 150. Any misted liquid directed toward the printer 104 or the air jet nozzle 146 is thereby blocked by the lowered blade 164 preventing any misted liquid or activated adhesive from entering the area of the printer 104 or clogging the air jet nozzle 146. Of course, if a different type of label web 110 which does not use a moisture- or liquid-activated adhesive is employed, the step described in FIG. 9 is not necessary.

Figure 10:
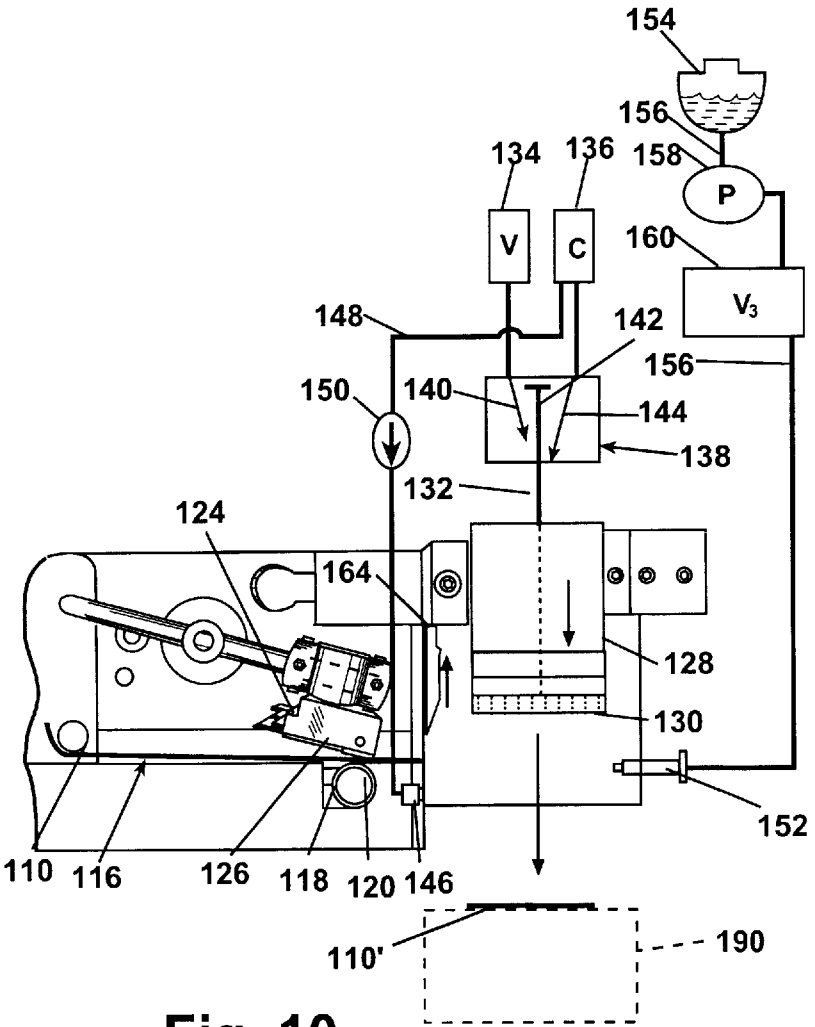
FIG. 10 is a partial schematic and front elevational view of the label printer/applicator shown in FIGS. 1–5 in similar orientation as FIG. 9 wherein the knife is raised to the position shown in FIG. 3, wherein the shuttle valve has been actuated to interconnect the head of the applicator with the source of pressurized air whereby the label is blown against an outer surface of an object to be labeled located remote from the applicator.

Once the label 110' is retained on the grid 130 and any activation of the adhesive thereon has been performed, the first valve 138 is repositioned to fluidly interconnect the third conduit 144 with the supply conduit 132. This, in turn, fluidly interconnects the distribution grid 130 of the head 128 with the pressurized air source 136 as shown in FIG. 10. The vacuum is thereby removed from the label 110' and a burst of pressurized air replaces the vacuum which causes the label 110' to be blown onto the object 190 to be labeled.

The blade 164 can be returned to the raised non-use position as shown in FIG. 10, the first valve 138 reset to the neutral position to remove fluid flow to and from the distribution grid 130, and a new length of label material 110 can be advanced from the printer 104.

Figure 11:
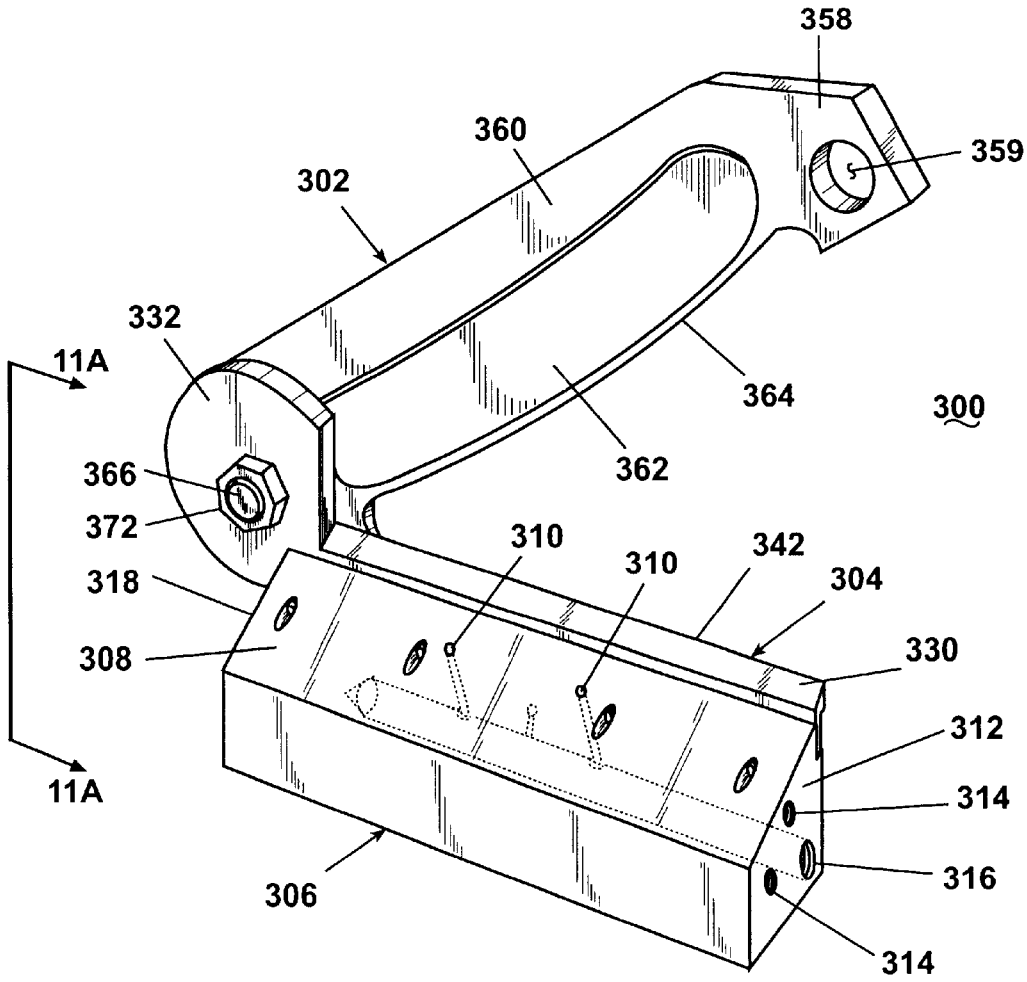
FIG. 11 is a front perspective view of an alternative embodiment of a cutting device for the printer/applicator of FIGS. 1–10.
Figure 11A:
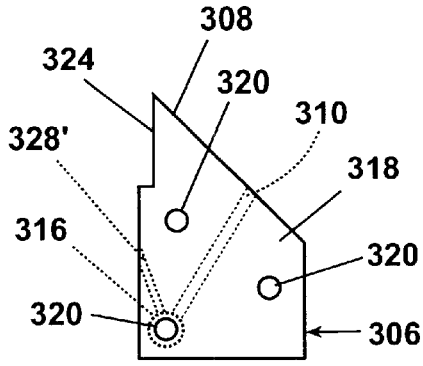
FIG. 11A is a side view of the cutting device taken along the lines A—A of FIG. 11.

Referring now to FIGS. 11 and 11A, an alternative embodiment of a cutting device 300 is shown comprising a pivoting blade 302, a fixed blade 304, and a base 306. The cutting device 300 is mounted to the label printer/applicator 100 and operated for the cutting of labels as hereinafter described.

The base 306 comprises a block of rigid material suitable for mounting to the label printer/applicator 100 and retains the fixed blade 304 as hereinafter described. The base 306 is preferably fabricated of steel or other rigid material suitable for the purposes described herein.

In the preferred embodiment, the base 306 comprises a beveled top surface 308 through which extend top air jets 310. The air jets 310 comprise fluid passageways extending from the top surface 308 in a generally downward direction. The block 306 comprises a first end 312 through which extend mounting apertures 314 and an air inlet port 316, and a second end 318 through which extend mounting apertures 320. The air inlet port 316 comprises a fluid passageway extending longitudinally into the interior of the base 306 which is in fluid communication with the top air jets 310. The mounting apertures 314, 320 are threaded to receive suitable fasteners, such as machine screws, for mounting the base 306 to the label printer/applicator 100.

Figure 12:
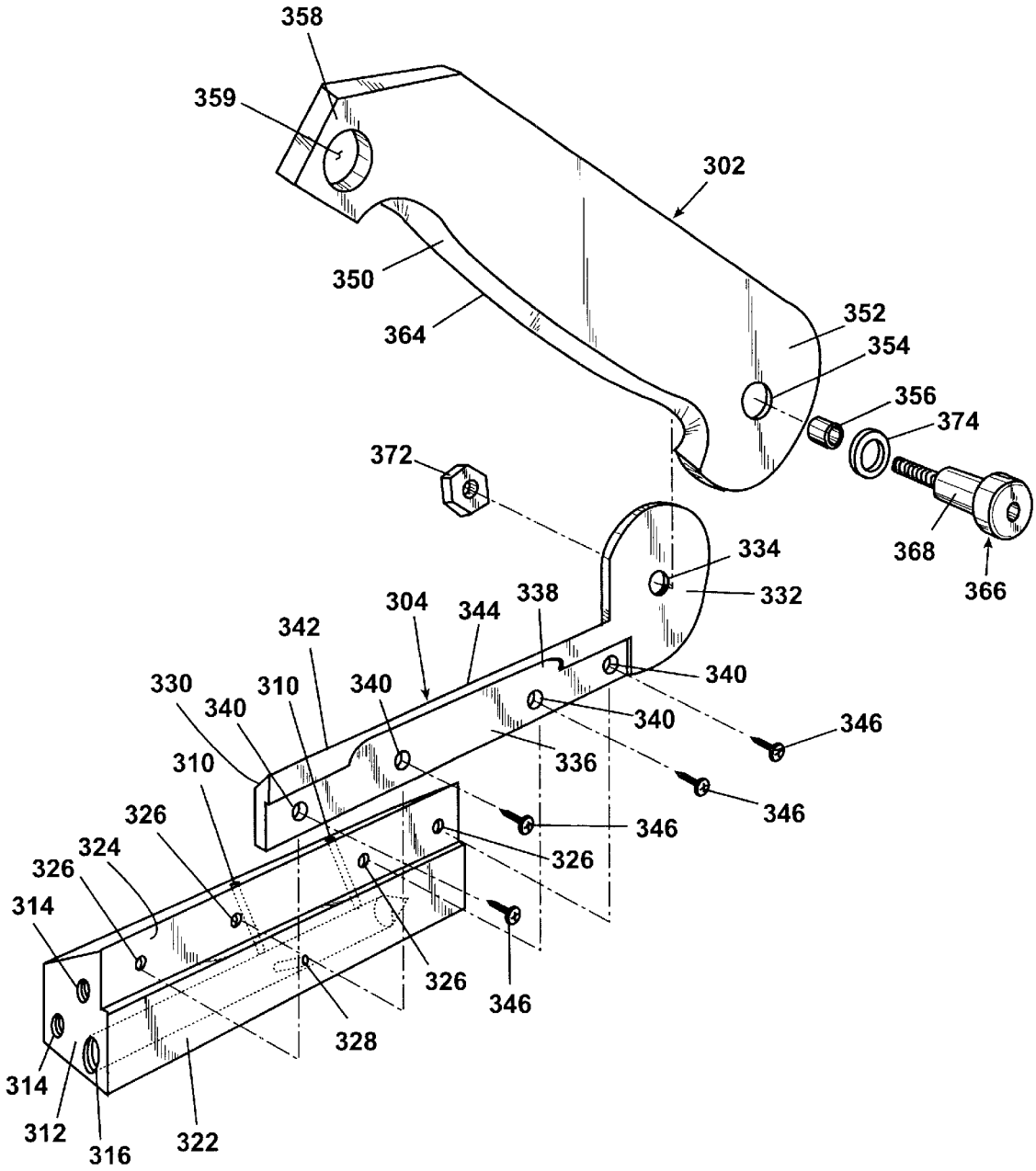
FIG. 12 is a rear exploded view of the cutting device of FIG. 11.

Referring also to FIG. 12 as well as FIGS. 11 and 11A, the base 306 also comprises a rear surface 322 which is provided with a notch 324, blade mounting apertures 326, and a rear air jet 328. In the preferred embodiment, the notch 324 extends in generally horizontal fashion across an upper portion of the rear surface 322 and is configured to receive the fixed blade 304 as hereinafter described. The blade mounting apertures 326 are threaded to receive suitable fasteners 346, such as machine screws, for mounting the fixed blade 304 to the base 306. The rear air jet 328 comprises a fluid passageway extending from the rear surface 322 in a generally downward direction and terminates in fluid communication with the air inlet port 316. The rear air jet 328 and the top air jets 310 direct the flow of air therethrough in a generally upward and angular direction.

The fixed blade 304 comprises a generally planar elongated member having a beveled edge 330, an upper edge of which forms a knife edge 344 for the blade 304 extending longitudinally along an upper edge of the blade 304, and a pivoting blade mounting flange 332 extending in axial fashion from one end of the blade 304. The fixed blade 304 is preferably comprised of a rigid material, such as hardened steel, suitable to maintain the knife edge 344 in a sharpened state for effective cutting of labels 110. The pivoting blade mounting flange 332 includes a pivot mounting aperture 334, which can optionally be threaded to receive a fastener, such as a screw, as hereinafter described.

A rear surface 342 of the fixed blade 304 has a mounting notch 336 and an adhesive notch 338. The mounting notch 336 is a generally rectangular indentation that extends in generally horizontal fashion across a lower portion of the rear surface 342 of the fixed blade 304. The adhesive notch 338 is an indentation that extends in generally horizontal fashion along at least a portion of the length of the mounting notch 336, is preferably centered with respect to the length of the fixed blade 304, and is preferably of sufficient width to correspond to the width of labels 110' to be cut with the fixed blade 304. The adhesive notch 338 extends outwardly from an upper edge of the mounting notch 336 and occupies at least a portion of the distance between the mounting notch 336 and an upper edge of the rear surface 342 of the fixed blade 304. Fixed blade apertures 340 are provided through the fixed blade 304 in a spaced horizontal relationship along the mounting notch 336 in cooperating alignment with the blade mounting apertures 326 on the base 306.

An intersection of corresponding upper edges of the rear blade surface 342 and the beveled edge 330 forms a fixed blade cutting edge 344. The fixed blade 304 is mounted to the base 306 by blade mounting fasteners 346 which, in one embodiment, are passed through the fixed blade apertures 340 and threaded into the blade mounting apertures 326.

The pivoting blade 302 comprises a generally planar elongated member comprising a curved beveled edge 350 extending longitudinally along a lower edge of the blade 302, a mounting flange 352 extending longitudinally from one end of the blade 302, and an actuator mounting flange 358 extending longitudinally from an opposite end of the blade 302. The pivoting blade 302 is preferably comprised of a rigid material, such as hardened steel, suitable to maintain a knife edge in a sharpened state for effective cutting of labels.

The blade mounting flange 352 has a pivoting blade mounting aperture 354 located in a generally central portion thereof that is adapted for mounting the pivoting blade 302 to the fixed blade 304. A bushing 356, preferably having a length generally equal to the thickness of the mounting flange 352, is preferably fixedly received within the pivoting blade mounting aperture 354. The actuator mounting flange 358 has an actuator mounting aperture 359 located in a generally central portion thereof. Although not critical to the operation of the device, the actuator mounting flange 358 is offset slightly downwardly from the remainder of the pivoting blade 302. It has been found that, when this blade is mounted to an actuator such as the pneumatically-actuated cylinder 172 and piston 174 described earlier, this offset positioning is advantageous in providing a consistent cutting pressure to a label 110'.

Referring now to FIG. 11, the pivoting blade 302 has a rear surface 360 which has an adhesive notch 362. The adhesive notch 362 is a shallow, curved channel, coextending generally along the curved beveled edge 350. The intersection of the pivoting blade rear surface 360 and the curved beveled edge 350 forms the pivoting blade edge 364.

A blade mounting bolt 366 comprises a smooth shaft portion 368 and a threaded shaft portion 370. The length of the smooth shaft portion 368 is preferably generally equal to the thickness of the mounting flange 352. The diameter of the smooth shaft portion 368 is slightly smaller than the inside diameter of the bushing so that the smooth shaft portion 368 is slidably and rotatably received within the bushing 356. The length of the threaded shaft portion 370 is generally equal to the thickness of the pivoting blade mounting flange 332 and a retaining nut 372. The pivoting blade 302 is attached to the fixed blade 304 by inserting the blade mounting bolt 366 through the pivoting blade bushing 356 and threading the threaded shaft 370 into the pivot mounting aperture 334. The pivoting blade 302 is thereby able to rotate about the smooth shaft portion 368. The blade mounting bolt 366 is then secured to the fixed blade 304 by the retaining nut 372. A washer 374 can also be preferably utilized between the head of the blade mounting bolt 366 and the mounting flange 352.

Figure 13:
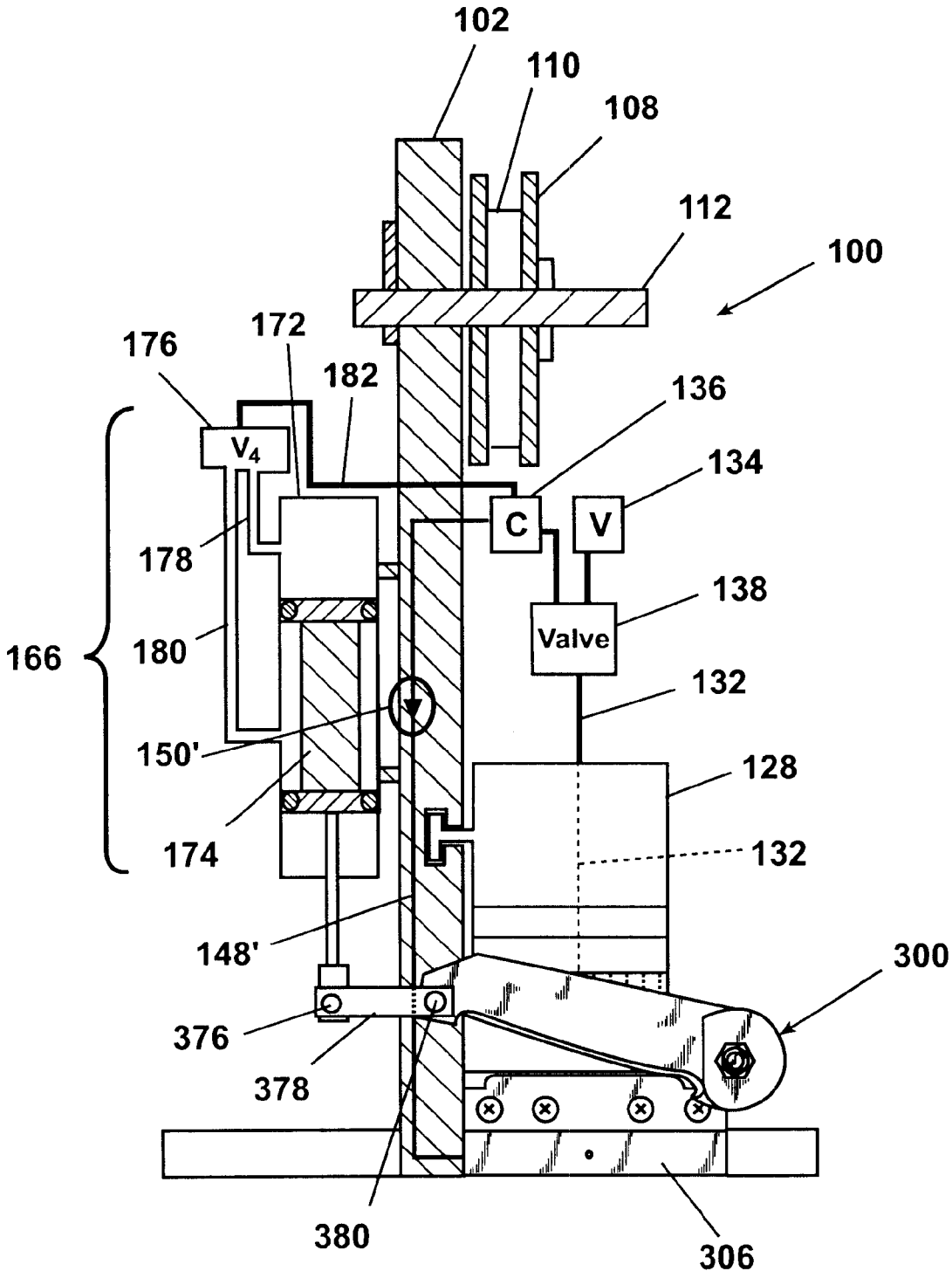
FIG. 13 is a front elevational view of the alternative embodiment of the cutting device of FIG. 11 mounted in the label/applicator.

Referring now to FIG. 13, the cutting device 300 is mounted to the label printer/applicator 100 by attaching the base 306 to the housing 102, which has been prepared to receive the base 306, with mounting screws (not shown) inserted into the mounting apertures 314, 320. It will be understood that this embodiment of the cutting device 300 is positioned between an outlet of the printer 104 and an inlet of the applicator 106. Thus, the cutting device 300 is optimally positioned to sever a label 100" from the web 110 prior to the application of the label 100" to an object to be labeled. The air inlet port 316 is fluidly connected to the pressurized air source 136 by the conduit 148". A valve 150" is fluidly connected into the conduit 148" between the pressurized air source 136 and the air inlet port 316 to control the flow of pressurized air to the air inlet port 316 and thus to the top air jets 310 and rear air jet 328. A piston arm 378 interconnects the piston 174 to the actuator mounting flange 358 and comprises an elongated member having first and second mounting apertures 376 and 380 that are pivotally mounted to a distal end of the piston 174 and the actuator mounting aperture 359, respectively, by suitable fasteners. The piston 174 is preferably rigidly attached to one end of the piston arm 378 and the other end of the piston arm 378 is pivotably attached to the actuator mounting flange 358.

It will be appreciated, with respect to the example embodiment shown in FIGS. 11–16, that the operation of the alternative embodiment of the cutting device 300 will require revalving of the cylinder 172 and the fourth valve 176 so that extension of the piston 174 will urge the pivoting blade 302 downwardly to sever a label 100" exiting the printer 104. Conversely, retraction of the piston 174 will urge the pivoting blade 302 upwardly to position the blade 302 in a raised no-nuse position out of obstruction of the advancement path of the label 100" exiting the printer 104.

Figure 14:
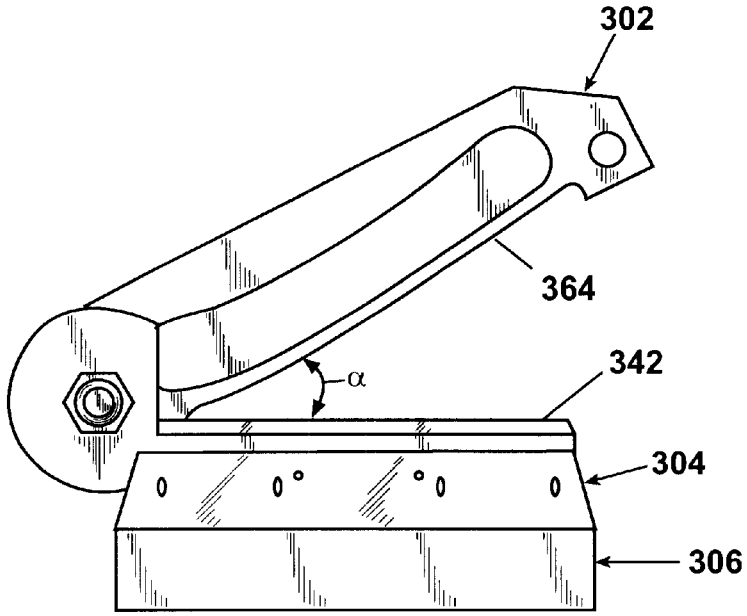
FIGS. 14–16 are a series of front elevational views of the alternative embodiment of the cutting device of FIG. 11 showing the progressive cutting position of a pivoting blade of the cutting device as the pivoting blade is moved from a raised position (FIG. 14), through an intermediate position (FIG. 15), and, finally, to a lowered position (FIG. 16).
Figure 15:
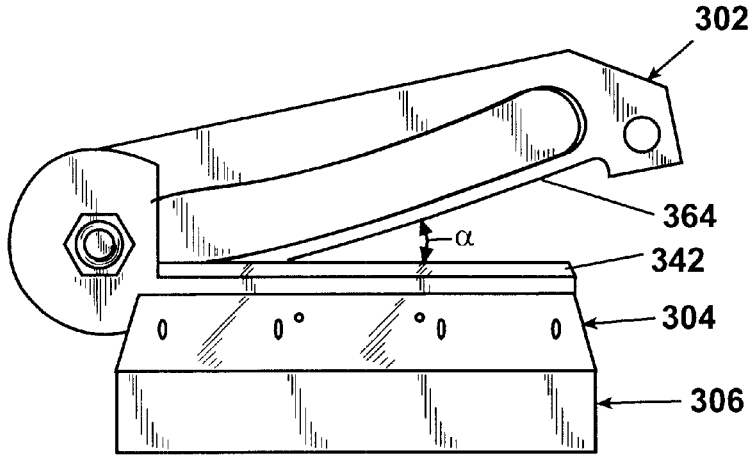
Figure 16:
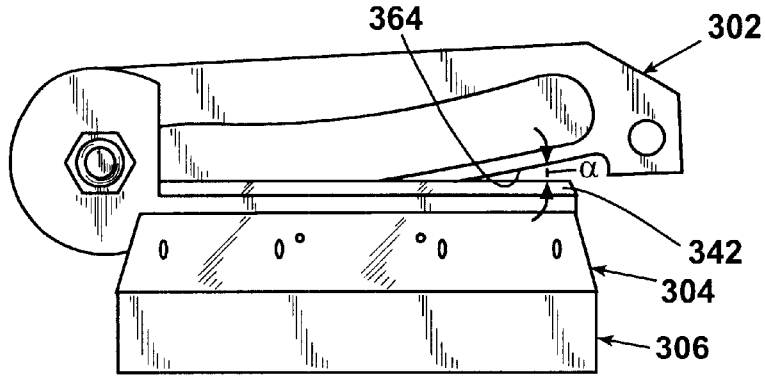

Referring now to FIGS. 14–16, the curvature of the pivoting blade edge 364 is configured to preferably result in a constant angle $\alpha$ of cut between a tangent to the pivoting blade edge 364 and the fixed blade edge 342 at the point where the two edges meet throughout the cutting stroke of the pivoting blade 302 relative to the fixed blade 304. This constant angle $\alpha$ provides an improved "slicing" action through the label web 110, thereby providing a superior label appearance and reducing the frequency of damaged labels.

The method of operation of the printer/applicator 100 with the alternative cutting device will be described with reference to FIG. 13. In general, the operation of the printer/applicator 100 with respect to the feeding of the label web 110, the printing of the label 100', and the activation of the adhesive is the same as previously described. Once the label 100" has been printed by the printer 104, it is advanced beyond the printer 104 in cantilever fashion. To sever the label 100" from the continuous web 110 exiting the printer 104, the fourth valve 176 is actuated to extend the piston 174 within the cylinder 172. The pivoting blade 302 is thereby lowered into the cutting position and, in turn, severs the label 100" from the web 110. To counteract the downward bending of the cantilevered label, the second valve 150" is actuated during the cutting cycle, which supplies pressurized air to the air inlet port 316, and thus through the top air jets 310 and the rear air jet 328. The pressurized air exiting the air jets 310, 328 blows the label 100" upward against the pivoting blade edge 364 where it is maintained in a generally horizontal position during the downward movement of the pivoting blade 302. This generally horizontal position of the label 100" and the force the label exerts against the blade edge 364 under the influence of the pressurized air from the air jets 310, 328 results in an improved cut and thus an improved label appearance. The operation of the vacuum to retain the label against the distribution grid 130 proceeds as with the first cutter embodiment. Similarly, activation of the adhesive and application of the label to the object 190 to be labeled proceeds as with the first embodiment.

After the cutting of the label, the pivoting blade 302 can be returned to the raised non-used position through retraction of the piston 174 and resetting of the valves as described with respect to the first embodiment.

During the cutting of adhesive-backed labels, small amounts of adhesive are removed from the label and deposited on the pivoting blade 302 and the fixed blade 304. With prior art cutting devices, this adhesive residue is distributed over the blade surfaces during subsequent cutting cycles, necessitating periodic shutting down of the operation to enable cleaning of the blades. In the alternative embodiment of the cutting device 300, the adhesive notch 362 of the pivoting blade 302 and the adhesive notch 338 of the fixed blade 304 collect the adhesive residue where it is redeposited on the labels during subsequent cutting cycles, thus reducing significantly the frequency that the operation must be shut down in order to clean the blades.

This adhesive accumulation effect is realized due to the recesses provided on the cutting blades 302 and 304, i.e., the lack of abutting planar surfaces on adjacent and abutting cutting blades. The recesses thereby accumulate the adhesive and can re-deposit the adhesive on labels in subsequent cutting operations.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. In a label application apparatus comprising:

a main housing having a roller thereon;

a supply reel mounted to the main housing and having an indefinite length web of label material thereon;

an applicator mounted to the main housing for applying a label to an object;

a feed mechanism for feeding the continuous web of label material from the supply reel to the applicator;

a cutting mechanism associated with the applicator comprising a pivotally-mounted blade and a stationary blade;

the improvement comprising:

wherein at least one of the pivotally-mounted blade and the stationary blade comprises a adhesive accumulation recess in register with the other of the pivotally-mounted blade and the stationary blade whereby excess adhesive encountered during cutting operations is accumulated in the adhesive accumulation recess and not on cutting surfaces of the at least one of the pivotally-mounted blade and the stationary blade.

2. The label application apparatus of claim 1 and further comprising a cylinder valve fluidly interconnected between the air cylinder and the source of pressurized air for selectively controlling a supply of pressurized air to the air cylinder.

3. The label application apparatus of claim 2 and further comprising a controller programmed to selectively actuate the cylinder valve to deliver a burst of pressurized air to the air cylinder to pivot the pivotally-mounted blade to a cutting position adjacent to the stationary blade.

4. The label application apparatus of claim 1 wherein at least one of the pivotally-mounted blade and the stationary blade comprises a curved cutting surface.

5. The label application apparatus of claim 4 wherein the curved cutting surface has a predetermined tangential angle which thereby configures the curved cutting surface to apply a generally constant cutting pressure to the web.

6. The label application apparatus of claim 1 wherein the pivotally-mounted blade is connected to an air cylinder and the air cylinder is connected to a source of pressurized air.

7. The label application apparatus of claim 1 wherein the adhesive accumulation recess extends substantially along the length of the at least one of the pivotally-mounted blade and the stationary blade.

8. In a label application apparatus comprising:

a main housing having a roller thereon;

a supply reel mounted to the main housing and having an indefinite length web of label material thereon;

a printer mounted to the main housing adjacent to the roller;

an applicator mounted to the main housing adjacent to the printer for applying a label to an object;

a feed mechanism for feeding the continuous web of label material from the supply reel to the printer and applicator;

a cutting mechanism associated with the applicator to cut the labels between the printer and the applicator, the cutting mechanism comprises a pivotally-mounted blade and a stationary blade;

the improvement comprising:

wherein the pivotally-mounted blade is connected to an air cylinder and the air cylinder is connected to a source of pressurized air, and at least one of the pivotally-mounted blade and the stationary blade comprises a longitudinally-extending adhesive accumulation recess in register with the other of the pivotally-mounted blade and the stationary blade whereby excess adhesive encountered during cutting operations is accumulated in the adhesive accumulation recess and not on cutting surfaces of the at least one of the pivotally-mounted blade and the stationary blade.

9. The label application apparatus of claim 8 and further comprising a cylinder valve fluidly interconnected between the air cylinder and the source of pressurized air for selectively controlling a supply of pressurized air to the air cylinder.

10. The label application apparatus of claim 9 and further comprising a controller programmed to selectively actuate the cylinder valve to deliver a burst of pressurized air to the air cylinder to pivot the pivotally-mounted blade to a cutting position adjacent to the stationary blade.

11. The label application apparatus of claim 8 wherein at least one of the pivotally-mounted blade and the stationary blade comprises a curved cutting surface.

12. The label application apparatus of claim 11 wherein the curved cutting surface has a predetermined tangential angle which thereby configures the curved cutting surface to apply a generally constant cutting pressure to the web.

13. In a label application apparatus comprising:

a main housing having a roller thereon;

a supply reel mounted to the main housing and having an indefinite length web of label material thereon;

a printer mounted to the main housing adjacent to the roller;

an applicator mounted to the main housing adjacent to the printer for applying a label to an object;

a feed mechanism for feeding the continuous web of label material from the supply reel to the printer and applicator;

a cutting mechanism associated with the applicator to cut the labels between the printer and the applicator, the cutting mechanism comprises a pivotally-mounted blade and a stationary blade;

the improvement comprising:

the pivotally-mounted blade is pivotally mounted to at least one of the stationary blade and the main housing;

the pivotally-mounted blade is connected to an air cylinder and the air cylinder is connected to a source of pressurized air, wherein the air cylinder is adapted to selectively move the pivotally-mounted blade between a raised position whereby the pivotally-mounted blade is located in a non-cutting position and a lowered position whereby the pivotally-mounted blade is moved to a cutting position;

wherein at least one of the pivotally-mounted blade and the stationary blade comprises a longitudinally-extending adhesive accumulation recess in register with the other of the pivotally-mounted blade and the stationary blade whereby excess adhesive encountered during cutting operations is accumulated in the adhesive accumulation recess and not on cutting surfaces of the at least one of the pivotally-mounted blade and the stationary blade.

14. The label application apparatus of claim 13 and further comprising a cylinder valve fluidly interconnected between the air cylinder and the source of pressurized air for selectively controlling a supply of pressurized air to the air cylinder.

15. The label application apparatus of claim 14 and further comprising a controller programmed to selectively actuate the cylinder valve to deliver a burst of pressurized air to the air cylinder to pivot the pivotally-mounted blade to the cutting position adjacent to the stationary blade.

16. The label application apparatus of claim 15 and further comprising a controller which is programmed to selectively actuate an atomizer valve to project a mist of adhesive-activating liquid beneath the applicator head before or substantially simultaneously with the application of a label onto an object by the applicator.

17. The label application apparatus of claim 16 and further comprising an air jet nozzle disposed adjacent to the printer and directed at the applicator head, the air jet nozzle being fluidly interconnected to the pressurized air source, a nozzle valve fluidly interconnected between the air jet nozzle and the pressurized air source for selectively controlling a supply of pressurized air to the air jet nozzle.

18. The label application apparatus of claim 13 wherein the stationary cutting blade includes a base and the base has at least one air jet fluidly interconnected to a source of pressurized air.

19. The label application apparatus of claim 18 wherein the at least one air jet is in register with a feed path of the web and aligned to direct a burst of pressurized air toward the web.

20. The label application apparatus of claim 19 wherein the at least one air jet comprises a pair of air jets directed generally transversely on opposing sides of the base.

21. The label application apparatus of claim 13 and further comprising a pair of air jets directed generally transversely on opposing sides of the stationary blade.

22. The label application apparatus of claim 13 wherein at least one of the pivotally-mounted blade and the stationary blade comprises a curved cutting surface.

23. The label application apparatus of claim 22 wherein the curved cutting surface has a predetermined tangential angle which thereby configures the curved cutting surface to apply a generally constant cutting pressure to the web.

* * * * *